US009162789B2

(12) United States Patent
Beyer et al.

(10) Patent No.: US 9,162,789 B2
(45) Date of Patent: Oct. 20, 2015

(54) CARD PRODUCT PACKAGE ASSEMBLY HAVING ENHANCED SECURITY

(71) Applicant: Blackhawk Network, Inc., Pleasanton, CA (US)

(72) Inventors: Darren Beyer, Berkeley, CA (US); Casey Bostwick, Dublin, CA (US)

(73) Assignee: BLACKHAWK NETWORK, INC., Pleasanton, CA (US)

( * ) Notice: Subject to any disclaimer, the term of this patent is extended or adjusted under 35 U.S.C. 154(b) by 232 days.

(21) Appl. No.: 13/719,689

(22) Filed: Dec. 19, 2012

(65) Prior Publication Data

US 2014/0116908 A1 May 1, 2014

Related U.S. Application Data

(60) Provisional application No. 61/718,622, filed on Oct. 25, 2012.

(51) Int. Cl.
*B65D 1/00* (2006.01)
*B65D 73/00* (2006.01)

(52) U.S. Cl.
CPC ..... *B65D 1/00* (2013.01); *B65D 73/0078* (2013.01); *B65D 2203/06* (2013.01); *B65D 2203/10* (2013.01)

(58) Field of Classification Search
CPC ..... B65D 73/0078; B65D 2203/00; A45C 11/182
USPC ..... 206/449, 308.1, 756, 736, 39, 767, 470, 206/232, 39.7; 235/380
See application file for complete search history.

(56) References Cited

U.S. PATENT DOCUMENTS

| | | | | |
|---|---|---|---|---|
| 5,650,209 | A * | 7/1997 | Ramsburg et al. | 428/43 |
| 6,299,530 | B1 * | 10/2001 | Hansted et al. | 462/64 |
| 6,659,271 | B2 * | 12/2003 | Parsons | 206/232 |
| 7,011,249 | B2 | 3/2006 | Tang | |
| 7,607,574 | B2 | 10/2009 | Kingsborough et al. | |

(Continued)

OTHER PUBLICATIONS

Filing receipt and specification for provisional patent application entitled "Card Product Package Assembly Having Enhanced Security," by Darren Beyer, et al., filed Oct. 25, 2012 as U.S. Appl. No. 61/718,622.

*Primary Examiner* — Steven A. Reynolds
(74) *Attorney, Agent, or Firm* — Wick Phillips Gould & Martin, LLP; Jerry C. Harris, Jr.

(57) ABSTRACT

A package for display and sale of a card product including a first portion including a first panel connected to a second panel via a first fold line and a third panel connected to the second panel via a second fold line, the first panel including a first opening, the third panel including a second opening, which, in a folded state where the first panel has been folded to overlap the second panel via the first fold line and the second panel has been folded to overlap the third panel via a second fold line and the fourth panel has been folded to overlap the third panel via the third fold line, the first opening at least partially overlaps the second opening, a second portion foldably connected to the first portion, wherein the second portion displays information about the card product, a first fastener, and a second fastener releasably attached to the first fastener when the first portion and the second portion are in a closed position, wherein the first fastener and the second fastener re-attachably separate from one another when the first portion and the second portion are in an open position.

20 Claims, 7 Drawing Sheets

(56) References Cited

U.S. PATENT DOCUMENTS

| | | | | |
|---|---|---|---|---|
| 7,607,575 | B2 | 10/2009 | Kingsborough et al. | |
| 8,157,086 | B1 * | 4/2012 | Gallegos et al. | 206/232 |
| 8,738,452 | B2 * | 5/2014 | Fowler | 705/20 |
| 8,807,332 | B1 * | 8/2014 | Pascua et al. | 206/39 |
| 8,898,939 | B2 * | 12/2014 | Kibbe et al. | 40/124.06 |
| 2001/0045738 | A1 * | 11/2001 | Klure | 283/61 |
| 2003/0004889 | A1 * | 1/2003 | Fiala et al. | 705/64 |
| 2005/0279825 | A1 * | 12/2005 | Ashby et al. | 235/380 |
| 2007/0063021 | A1 * | 3/2007 | Chakiris et al. | 235/380 |
| 2007/0063052 | A1 * | 3/2007 | Chakiris et al. | 235/486 |
| 2008/0314791 | A1 * | 12/2008 | Schweitzer et al. | 206/703 |
| 2009/0038968 | A1 * | 2/2009 | Smith | 206/307 |
| 2009/0199516 | A1 * | 8/2009 | Gustavsson | 53/467 |
| 2011/0137793 | A1 * | 6/2011 | Liggett | 705/41 |

* cited by examiner

CARD PRODUCT PACKAGE ASSEMBLY HAVING ENHANCED SECURITY

CROSS-REFERENCE TO RELATED APPLICATIONS

This application claims the benefit under 35 U.S.C. §119 (e) of U.S. Provisional Patent Application No. 61/718,622 filed Oct. 25, 2012 and entitled "Card Product Package Assembly Having Enhanced Security," the disclosure of which is hereby incorporated herein by reference.

STATEMENT REGARDING FEDERALLY SPONSORED RESEARCH OR DEVELOPMENT

Not applicable.

REFERENCE TO A MICROFICHE APPENDIX

Not applicable.

FIELD OF THE INVENTION

The disclosure generally relates to package assemblies for card products such as gift cards, debit cards, credit cards, discount cards, pharmaceutical cards, and the like.

BACKGROUND OF THE INVENTION

The market for card products such a merchant gift cards continues to grow. Such cards may be subject to fraud, for example by a thief removing a valid gift card from a card holder that is used to activate the card, and inserting a fraudulent gift card in the holder. This activity, sometimes referred to a swapping, results in activation of the valid card held by the thief and non-activation of the fraudulent card held by the unsuspecting consumer. As a result, an ongoing need exists for improved card product package assemblies, which is addressed by the present disclosure.

SUMMARY OF THE INVENTION

Disclosed herein is a package for display and sale of a card product comprising a first portion including a first panel connected to a second panel via a first fold line and a third panel connected to the second panel via a second fold line, the first panel including a first opening, the third panel including a second opening, which, in a folded state where the first panel has been folded to overlap the second panel via the first fold line and the second panel has been folded to overlap the third panel via a second fold line and the fourth panel has been folded to overlap the third panel via the third fold line, the first opening at least partially overlaps the second opening, a second portion foldably connected to the first portion, wherein the second portion displays information about the card product, a first fastener, and a second fastener releasably attached to the first fastener when the first portion and the second portion are in a closed position, wherein the first fastener and the second fastener re-attachably separate from one another when the first portion and the second portion are in an open position.

Also disclosed herein is a method for display and sale of a card product comprising providing a first portion of a package having the card product removably attached therein, enclosing the card product within the first portion when the first portion is in a folded state, providing a second portion of the package foldably connected to the first portion, releasably attaching a first fastener to a second fastener when the first and second portions are in the closed position, wherein the first and second fasteners are reattachably-separable, displaying information relating to the card product on the second portion when the first and second portions are in the closed position and in an open position, and revealing at least a portion of the card product through an opening formed in the first portion.

Further disclosed herein is a package system comprising a first portion including a first panel connected to a second panel via a first fold line and a third panel connected to the second panel via a second fold line, the first panel including a first opening, the third panel including a second opening, which, in a folded state where the first panel has been folded to overlap the second panel via the first fold line and the second panel has been folded to overlap the third panel via a second fold line and the fourth panel has been folded to overlap the third panel via the third fold line, the first opening at least partially overlaps the second opening, a card product on which information is recorded, wherein the card product is removably attached to the first portion, wherein information on the card product is scannable or viewable through the first and second openings, a second portion foldably connected to the first portion, wherein the second portion displays information about the card product, a first fastener, and a second fastener releasably attached to the first fastener when the first portion and the second portion are in a closed position, wherein the first fastener and the second fastener re-attachably separated from one another when the first portion and the second portion are in an open position.

DETAILED DESCRIPTION OF THE PREFERRED EMBODIMENTS

Figure 1:
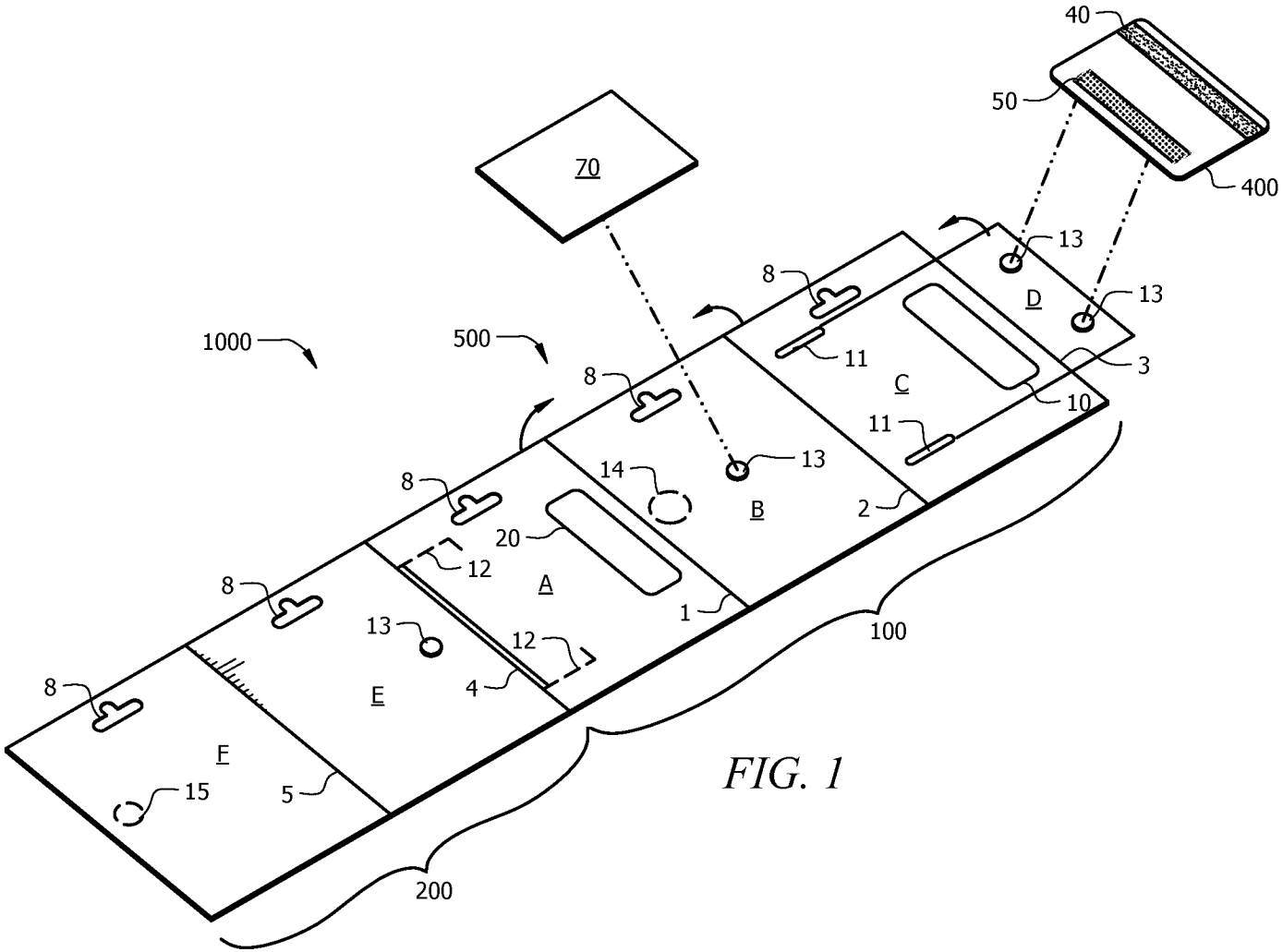
FIG. 1 shows a perspective view of an embodiment of the system and package.

As used herein, card product refers to a card that may be used to transact business with a party willing to accept the card, for example as tender for a purchase or discount for a purchase. As used herein, card product may also refer to a card used for promotional and/or marketing purposes. Examples of such cards include credit cards, debit cards, gift cards, telephone cards, loyalty cards, membership cards, ticket cards, entertainment cards, sports cards, prepaid cards, discount cards, healthcare cards and the like. Typically, such cards are wallet-sized and made of plastic. In various embodiments, the card product may be a type of card such as a gift or prepaid card that requires activation at a point of sale. For example, a card product may be purchased and activated at a point of sale by a consumer and subsequently used by the consumer or another (e.g., the recipient of the card as a gift) to transact business.

Purchase of a card product may involve a card vendor, a redeeming merchant, and a card issuer. In various embodiments, the card vendor, redeeming merchant and card issuer may be the same, different, or related entities. The point of sale where the card is purchased and activated is referred to herein as the card vendor or simply vendor. An entity that will accept the card for business transactions, for example as tender for a purchase, is referred to as a redeeming merchant. An entity that provides the financial backing and/or payment processing accessed via the card product is referred to as the card issuer or simply issuer. Typically, the issuer is identified on the card product and associates a unique issuer account code with each card product. Card issuers may include direct issuers of cards such as store-branded cards, and in some embodiments the card vendor may also be the card issuer and/or the redeeming merchant. Card issuers also may include banks, financial institutions, and transaction processors such as VISA, Mastercard, American Express, etc., and cards issued by such institutions may be readily accepted by a number of redeeming merchants to conduct transactions such as purchases. Card issuers may be in various industries, such as the entertainment, health, medical, pharmaceutical industries. For example, the card issuer may be a pharmaceutical company utilizing cards and packages for pharmaceutical products. In some instances, the redeeming merchant may be identified on the card product (for example, a retailer branded card such as Store X), and such cards may be sold at the same or different card vendor (e.g., card vendor is Store X or a different or unrelated Store Z). In such instances, the Store X branded card product may be issued by Store X, by Store Z, or by a third party such as bank or financial institution.

The disclosed package may be used for display and sale of a card product. The package generally comprises a first portion, a second portion foldably connected to the first portion, and an optional third portion foldably connected to the first portion. The first portion may have three panels, or optionally, four panels. The second portion may have two panels, or optionally, three panels. The third portion may have at least one panel. The first portion may have a folded state where all panels are folded upon one another and an unfolded state where none of the panels are folded upon another. The second portion may have a folded state where all panels are folded upon one another and an unfolded state where none of the panels are folded upon another. The first portion and second portion may have a closed position where the first portion and second portion are folded upon one another, and the first portion and second portion may have an open position where the first portion and second portion are not folded upon one another. The first, second, and optional third portions may display information about the card product, including but not limited to advertising, logos, warnings, disclaimers, agreements, marketing material, product information, guidelines, rules, the like, or combinations thereof.

FIG. 1 shows a perspective view of an embodiment of the disclosed system 1000 and package 500. The package 500 may comprise a first portion 100, a second portion 200 foldably connected to the first portion 100, a first fastener 14, and a second fastener 15. The system may comprise the package 500 and a card product 400 removably attached to the first portion 100 of the package 500.

The first portion 100 is shown in FIG. 1 in the unfolded state, the second portion 200 is shown in the unfolded state, and first portion 100 and second portion 200 are in the open position. First portion 100 may have a first panel A connected to a second panel B via a first fold line 1, and a third panel C may be connected to the second panel B via a second fold line 2. Optionally, the first portion 100 may have a fourth panel D connected to the third panel C via a third fold line 3. In FIG. 1, the second portion 200 is foldably connected to the first portion 100 via fold line 4, and it is contemplated that embodiments of the disclosed system 1000 and package 500 may have second portion 200 foldably connected to the first portion 100 via other fold lines. The second portion 200 may have a inner panel E connected to an outer panel F via fold line 5. In an embodiment, the system 1000 may comprise a package 500 configured according to the disclosed package embodiments, and a card product 400.

The second portion 200 of the package 500 and system 1000 may comprise an inner panel E foldably connected to the first portion 100, and an outer panel F foldably connected to a side of the inner panel E opposite the first portion 100. In FIG. 1, the inner panel E may be connected to the first panel A of the first portion 100 via fold line 4.

The first fastener 14 and second fastener 15 are shown as reattachably separated from one another in FIG. 1. In an embodiment, the second fastener 15 may be releasably attached to first fastener 14 when the first portion 100 and the second portion 200 are in a closed position. The first fastener 14 and second fastener 15 together may comprise a hook-and-loop fastener. In an embodiment, the first fastener 14 and the second fastener 15 may differ in size. For example, first fastener 14 may be larger than second fastener 15, or vice versa. In FIG. 1, the first fastener 14 may be positioned on the first portion 100, and the second fastener 15 may be positioned on the second portion 200. Particularly, the first fastener 14 may be positioned on the second panel B of the first portion 100 adjacent the first fold line 1, and the second fastener 15 may be positioned on the outer panel F of the second portion 200 on a side of the outer panel F opposite the inner panel E. The dashed lines of the fasteners 14 and 15 indicate the fasteners are positioned on the face of the panels F and B not viewable from the perspective shown in FIG. 1.

The first panel A may include an opening 20, and the third panel C may include an opening 10. Opening 20 may at least partially overlap opening 10 when the first portion 100 is in the folded state. The card product 400 may have information recorded thereon, and information on the card product 400 may be scannable or viewable through the openings 10 and/or 20 when the first portion 100 is in the folded state. To be in the folded state, third panel C may be folded to overlap the second panel B via second fold line 2 and the first panel A may be folded to overlap the folded third panel C via the first fold line 1.

The card product 400 may be attached to the right-most portion of the first portion 100 of the package 500. In the embodiment of the invention shown in FIG. 1, the card product 400 may be attached to the fourth panel D via a means known in the art, for example, glue dots 13. The card product 400 may partially overlap the fourth panel D and may extend rightward away from the fourth panel D so as to expose a portion of the card product 400 to a magnetic reader (not shown), which reads a magnetic strip 40 disposed on the card product 400.

Third panel C typically may include a "sombrero" 8 or hanger opening through which a peg may extend in order to support the paperboard package, for example, in a retail display. As shown in FIG. 1, panels A, B, D, E, and F may also include sombreros 8 so that, upon folding completely, the sombreros overlap one another and allow a peg to extend through the completely folded system 1000. In other embodiments, one or more of panels of the first and second portions 100 and 200 may have a height less than a height of the panel which includes the sombrero, so as to avoid manufacturing sombreros into every panel of package 500 of system 1000. In one non-limiting embodiment, the sombreros are sized so as to put forth a smaller sombrero for viewing by a potential customer while the package is hanging on a peg and to partially hide interior sombreros from view by making the interior sombreros larger than the exterior-most sombrero.

The first panel A of the first portion 100 may include tabs 12, bounded in part, by perforated portions of the first panel A. The tabs 12 may extend to an edge of the first panel A opposite of the first fold line 1. Third panel C may include elongated slots 11. The slots 11 may be positioned in a direction perpendicular to the second fold line 2. The slots 11 may overlap one or more of tabs 12.

In an embodiment, the card product 400 may include a barcode 50 and a magnetic portion 40, such as a magnetic strip, and both the barcode 50 and the magnetic portion 40 may include recorded information. The barcode 50 may be scannable through the openings 10 and 20 when the first portion 100 is in the folded state. In an embodiment, the barcode 50 may be scannable through the openings 10 and 20 when the first portion 100 and second portion 200 are in the closed position. In an alternative embodiment, the card product 400 may include an entry code (not shown) and a magnetic portion 40, and the magnetic portion 40 may include recorded information. The entry code may be viewable through the openings 10 and 20 when the first portion 100 is in the folded state; moreover, the entry code may be viewable through the openings 10 and 20 when the first portion 100 and second portion 200 are in the closed position.

In an embodiment, a face of the outer panel F of the second portion 200 may be releasably attached with an adhesive 13 to a face of the inner panel E of the second portion 200 when the second portion 200 is in the folded state. In FIG. 1, adhesive 13 is shown as placed on inner panel E of the second portion.

Third panel C typically includes two elongated slots 11 through which tabs 12 disposed on first panel A may be tucked when the first portion 100 is in the folded state so as to maintain the first portion 100 in a folded state even after the perforated portions on first panel A are torn away from the majority portion of first panel A. In other words, the first portion 100 may be maintained in a folded state after opening by using tabs 12 on panel D inasmuch as the tabs 12 can be tucked into the elongated slots 11 on third panel C.

In an embodiment, a booklet 70 may be connected to or releasably attached to the first portion 100 or second portion 200. The booklet 70 may comprise a contract, license agreement, instructions, folded terms, marketing materials, advertising materials, or combinations thereof, for example. As shown in FIG. 1, the booklet 70 may be attached to the interior surface of second panel B via one or more glue dots 13. Various adhesives or other conventional bonding techniques may be used to attach the booklet 70 to the interior side of second panel B. In accordance with the disclosed embodiments, it is contemplated the booklet 70 may be attached to any of the fold lines of the package 500 by methods known in the art.

In an embodiment, the outer panel F of the second portion 200 may have a width smaller than a width of the inner panel E of the second portion 200. In an embodiment, fourth panel D of the first portion 100 is shown in FIG. 1 to be smaller than the panels A-C. In alternative embodiments, other sizes of panels are possible. Furthermore, it is not necessary for the openings 10 and 20 to be identically sized. Rather, as discussed above regarding the sombreros 8, it is possible to size one of the openings 10 or 20 smaller than the other, such as for example, opening 20, so that the opening 10 will not unattractively overlap the opening 20 and expose an edge to a viewer when the first portion 100 is in the folded state.

As used herein, "completely folded" refers to when any of the first portion, second portion, and optional third portion are in the folded state; when any combination of the first portion, second portion, and optional third portion are in the folded state; when the first portion, second portion, and optional third portion are in the closed position; or combinations thereof.

In the folded state of the first portion 100 shown in FIG. 1, fourth panel D of the first portion 100 may be folded to overlap the third panel C via third fold line 3, third panel C may be folded to overlap the second panel B via the second fold line 2, and first panel A may be folded to overlap the third panel C via the first fold line 1. In this state, opening 20 may at least partially overlap opening 10. In embodiments with an optional fourth panel D, the fourth panel D may fold about third panel C via fold line 3 such that a barcode 50 disposed on the card 400 aligns with opening 10 formed in third panel C. Thus, fourth panel D may be folded against third panel C, and the card product 400 may be partially exposed through the opening 10.

In the folded state of the second portion 200, outer panel F may fold about inner panel E via fold line 5.

In the closed position, the first portion 100 in the folded state and the second portion 200 in the folded state fold against one another via fold line 4. In FIG. 1, the second portion 200 is shown as connected to the first portion 100 via fold line 4; however, it is contemplated second portion 200 may be connected to the first portion 100 via other fold lines, e.g., fold line 1, fold line 2, fold line 3, and the like.

Various decorative or informative designs may be printed on individual panels of the first portion 100, second portion 200, optional third portion 300, or combinations thereof. For example, pricing information or other instructions regarding use of the card product 400 may be displayed on the exterior surface of second panel B. Alternatively, or in addition to a display on second panel B, the exterior face of first panel A may include attractive advertising designs.

The system 1000 and package 500 are designed for display and easy activation of the card product 400. One application of this embodiment includes the containment of secure open loop prepaid cards displayed in a retail environment. In embodiments wherein the card product 400 requires activation, the disclosed system 1000 and package 500 present two methods for accessing the card product 400, i.e. a dual-method access scheme.

A first method for accessing the card product 400 may be via scanning a barcode 50 on the card product 400. The barcode 50 may be accessible through openings 10 and 20. Openings 10 and 20 may be die cut. The openings 10 and 20 may be aligned and oriented in such a way that the card product 400 can be scanned and activated while still securely held inside the package 500. This provides for a fast and easy checkout experience. In an embodiment where the openings 10 and 20 reveal the card product 400 when the portions of the system 1000 and package 500 are in the closed position, the bar code 50 may be scanned without disturbing the completely folded position of the package 500. In an alternative embodiment where unfolding of the portions must occur to reveal the card product 400, a method to access the card product 400 may involve reattachably separating the first fastener 14 and the second fastener 15 by unfolding the first portion 100, second portion 200, and/or optional third portion 300 from the closed position to the open position. In an embodiment where the second portion 200 or optional third portion 300 obstructs any of the openings 10 or 20, an additional step may include unfolding the second portion 200 or optional third portion 300 so that card product 400 is revealed through the first portion 100. In the above-discussed method steps, the portions 100, 200, and optional 300 may remain in the folded state during activation of the card product 400.

A second method of accessing the card product 400 generally may include opening the package 500 from the closed position to the open position. The method to access and activate the card product 400 involves:

1) releasably separating the first fastener 14 and the second fastener 15 by unfolding the first portion 100, second portion 200, and/or optional third portion 300 from the closed position to the open position;
2) untucking the tabs 12 from the elongated slots 11 of the first portion 100;
3) unfolding the panels (A-C, and optional D) of the first portion 100 from the folded state to the unfolded state; and
4) revealing the card product 400, being releasably attached to a panel (e.g., third panel C or fourth panel D) of the first portion 100 of the package 500.

The package 500 may be returned to the folded state by folding the panels (A-C, optionally D) of the first portion 100 to return the first portion 100 to the folded state, and resealing the first portion 100 via tabs 12 of the first panel A in the elongated slots 11 of the third panel C.

The embodiments of the package and system shown herein provide a solution for retail outlets that activate cards by either barcode or magnetic strip, thereby eliminating the need for maintaining an inventory of multiple package types. This embodiment also provides tamper evidence. By keeping the card securely glued to a package's panel up to, and through the process of activation, it is extremely difficult to compromise the package and remove the card without making the removal obvious and evident. Various glues may be used, and the package itself may be made of paper, cardboard, tagboard, plastic, or foil, for example.

In embodiments, a security code may be included on the card product 400. The security code may be used in addition or in lieu of the magnetic strip 40 and barcode 50. The security code may also serve a secondary or dual purpose, such as encoding information useful for purchase and/or activation of the card product. For example, the dual purpose security code may comprise a unique bar code that may be scanned at a point of sale terminal to purchase and/or activate the card product. An example of such a unique bar code is an EAN/UCC-128 bar code, containing both a vendor product identification portion and an issuer account portion. The EAN/UCC-128 bar code may be used to activate the card via a one-step process.

In embodiments wherein the card product 400 requires activation, the disclosed system 1000 and package 500 present multiple methods for activation, i.e. a multi-method activation scheme. Methods for activating the card product 400 may include scanning the barcode 50, swiping the magnetic strip 40 of the card product 400, entering or scanning the security code, or combinations thereof. In embodiments where the method for activating the card product 400 comprises a one-step activation method, the one step comprises simultaneously entering the combination vendor product identification and issuer account code at a point of sale terminal. The one-step process only requires a single entry by a clerk operating the point of sale terminal to activate the card product. For example, the one step may be performed at the point of sale terminal by scanning the bar code 50, for example an EAN/UCC-128 bar code, containing both a vendor product identification portion and an issuer account portion. The vendor product identification portion may be used to perform a look-up to determine product identity and price. The issuer account portion may be used to activate the particular account associated with the card product such that the card may be used to transact business with the issuer of the card. Upon being entered at the point of sale terminal, the issuer account code may be conveyed (for example, via a computer network) to the issuer or other third party processor responsible for looking up the account code (for example, via a database reconciliation) and activating same. In alternative embodiment, the one step may be performed at the point of sale terminal by swiping the magnetic strip 40 containing both a vendor product identification portion and an issuer account portion.

Package assembly embodiments as described herein may be manufactured according to various methods known in the art. For example, card products and packages can be manufactured and printed and subsequently placed in a printed rack hanger, or alternatively the card product and package can be made concurrently, for example via coextrusion of a plastic sheet with subsequent printing and placed in a printed rack hanger. Where made of a plastic or polymer, the type of material may be selected to provide appropriate functional characteristics such as printability, gloss, the ability to snap and break along a perforation, the like, or combinations thereof. In some embodiment, security codes may be applied to prefabricated package assemblies via stickers spanning the card product and the card holder. Alternative methods of making the various embodiments disclosed herein will be apparent to those skilled in the art.

One benefit of the above-noted arrangement is that the card product 400 may be scanned via a barcode reader when the first portion 100 is completely folded in the folded state, and the card product 400 may be magnetically scanned as with a magnetic strip reader when the card product 400 is still attached to the first portion 100. Additionally, first portion 100 may be unfolded and refolded to the folded state without removing the card product 400, once the card product 400 is scanned via a magnetic card reader.

Figure 2:
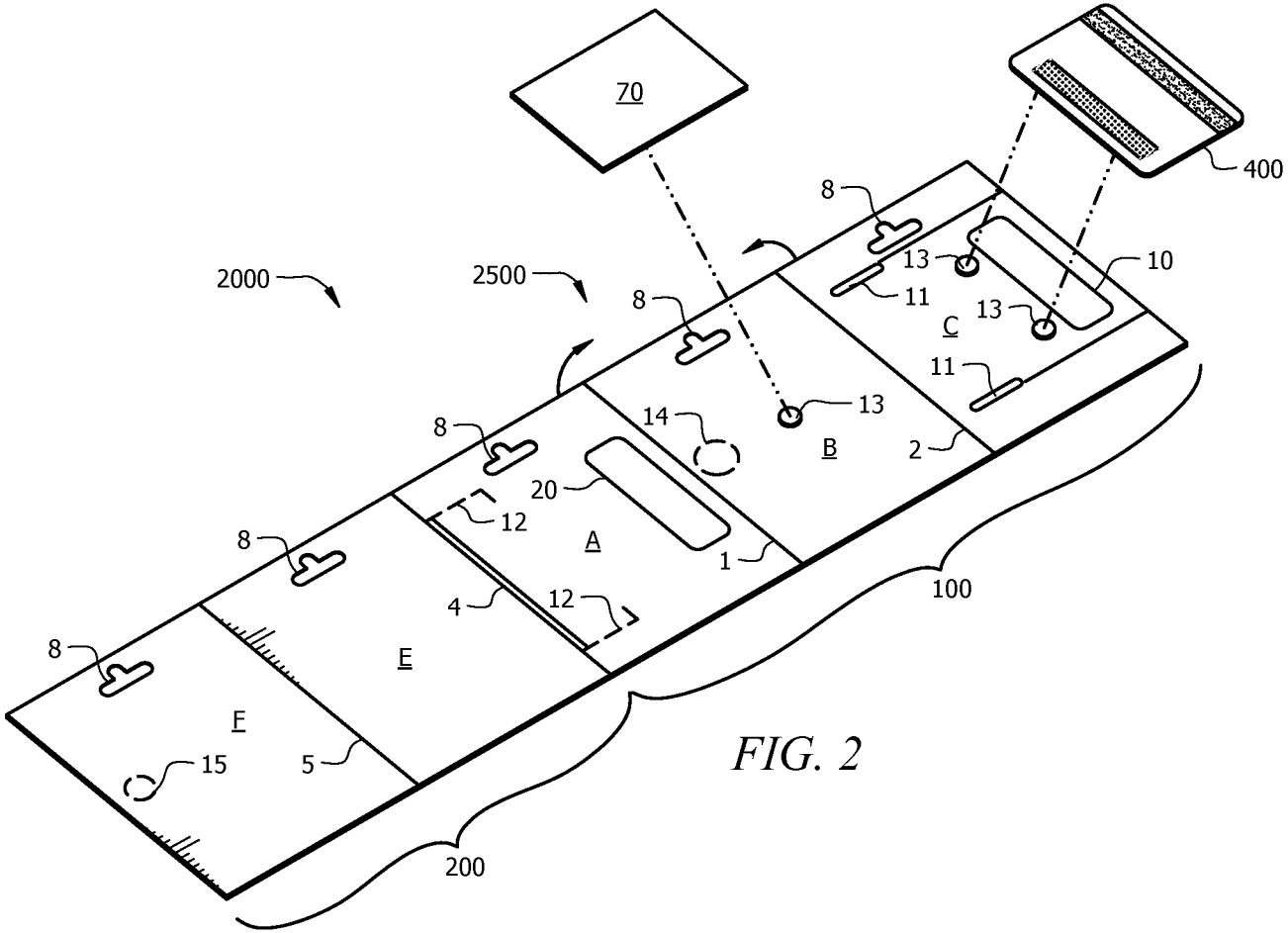
FIG. 2 shows a perspective view of an alternative embodiment of the system and package shown in FIG. 1.

FIG. 2 shows a perspective view of an alternative embodiment of the system and package shown in FIG. 1. The system 2000 and package 2500 shown in FIG. 2 may have three panels A-C in the first portion 100. In such an embodiment, the card product 400 may be attached to third panel C. In embodiments, the card product 400 may be attached to third panel C via one or more glue dots 13. The glue dots 13 may be made with a semi-permanent gel, rubber cement, or wax in order to allow a user to easily remove the card product 400 without damaging it. The fold lines 1-5 may be made via perforation or scoring, for example. Other methods are available.

Figure 3:
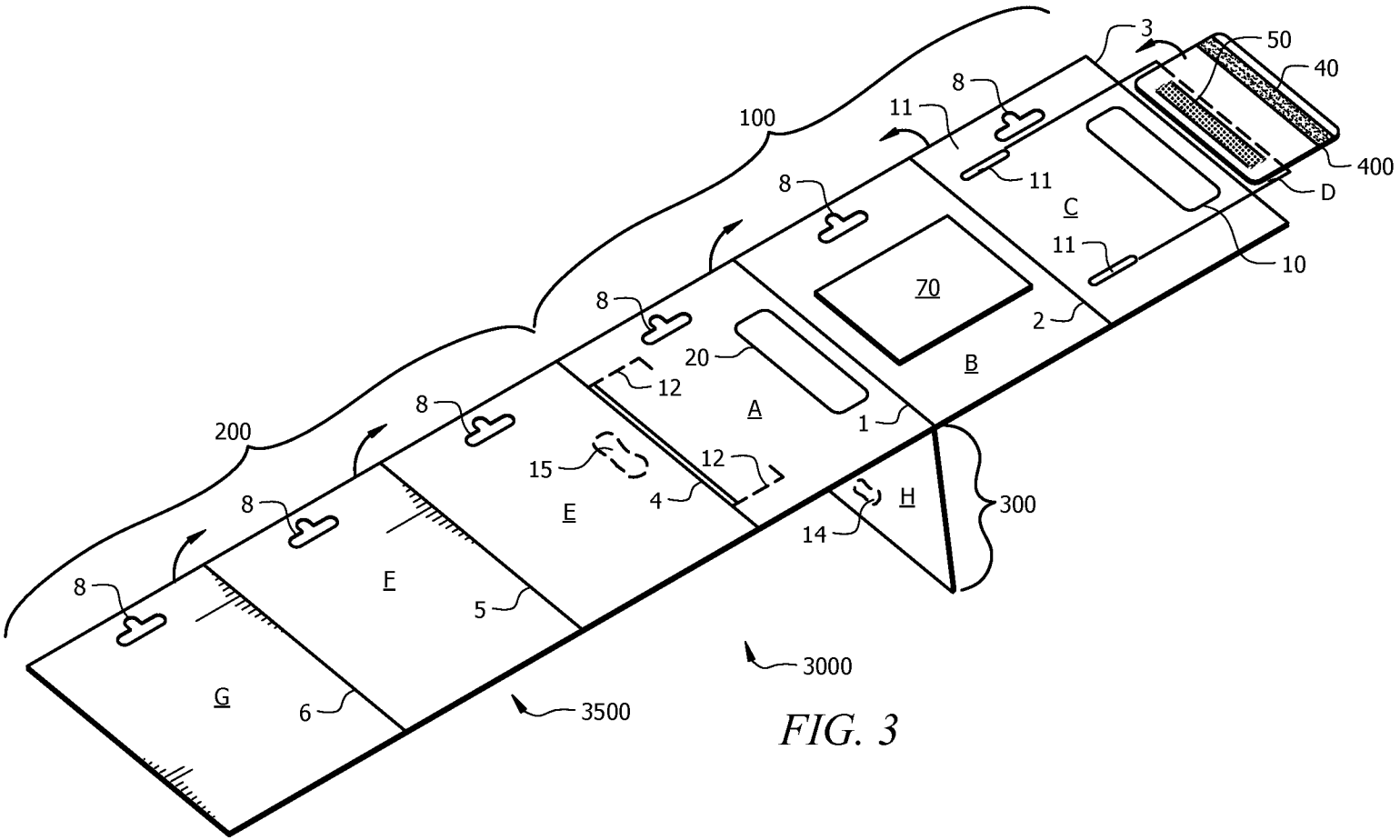
FIG. 3 shows a perspective view of an embodiment of the system and package.

FIG. 3 shows a perspective view of an embodiment of the disclosed system 3000 and package 3500. The package 3000 may comprise a first portion 100, a second portion 200 foldably connected to the first portion 100, a third portion 300 foldably connected to the first portion 100, a first fastener 14, and a second fastener 15. The system 3000 may comprise the package 3500 and a card product 400 removably attached to the first portion 100 of the package 3500.

In FIG. 3, the first portion 100 is shown in the unfolded state, the second portion 200 is shown in the unfolded state, the third portion 300 is shown in the unfolded state, and first portion 100 and second portion 200 and third portion 300 are in the open position. The first portion 100 comprises four panels A-D connected at fold lines 1-3, the second portion 200 comprises three panels E-F connected at fold lines 4-6, and the third portion 300 comprises a panel H connected to the first portion 100 at fold line 1.

The second portion 200 may comprise an inner panel E foldably connected to the first portion 100 of the system 3000 and package 3500. The second portion 200 may further comprise an intermediate panel F foldably connected to a side of the inner panel E opposite the first portion 100 via fold line 5, and an outer panel G foldably connected to a side of the intermediate panel F opposite the inner panel E (and the first portion 100) via fold line 6.

The first fastener 14 may be attached to the panel H of the third portion 300, and the second fastener 15 may be attached to the inner panel E of the second portion 200. In embodiments of the disclosed system and package which do not include a third portion, the first fastener 14 may be attached to the first portion 100.

The first portion 100 of package 3500 and system 3000 may fold from the unfolded state to the folded state in the same manner as described for the first portion 100 of the package 500 and system 1000 of FIG. 1.

The second portion 200 may fold from the unfolded state to the folded state. In the folded state of the second portion 200 of system 3000 and package 3500, outer panel G may fold about intermediate panel F via fold line 6, intermediate panel F may fold about inner panel E via fold line 5, and inner panel E may fold about first portion 100 via fold line 4. In an embodiment, intermediate panel F may first fold about inner panel E via fold line 5, then outer panel G may fold about intermediate panel F via fold line 6. In another embodiment, outer panel G may first fold about intermediate panel F, and then folded panels F and G may fold about inner panel E via fold line 5.

The third portion 300 shown in FIG. 3 is a single panel H; however, it is contemplated the third portion 300 may comprise two or more panels which may be folded to a folded state in schemes similar to those disclosed for the first and second portions 100 and 200.

The package 3500 and system 3000 may fold to the closed position when the first portion 100, second portion 200, and third portion 300 are in the folded state. The first portion 100 may be folded into the folded state in the direction of the arrows shown in FIG. 3 and according to the folding scheme disclosed above for the first portion 100. Once the first portion 100 is in the folded state, the second portion 200 may be folded to the folded state; or the second portion 200 may be folded to the folded state before the first portion 100. The second portion 200 may be folded to the folded state in the direction of the arrows shown in FIG. 3. Once the first and second portions 100 and 200 are in the folded state, panel H of third portion 300 may be then folded about panel E of the second portion 200 via fold line 1 so that first and second fasteners 14 and 15 may releasably attach. In FIG. 3, fasteners 14 and 15 may have a different size. For example, in FIG. 3, first fastener 14 is smaller than second fastener 15. The dashed lines of the fasteners 14 and 15 indicate the fasteners are positioned on the face of the panels F and B not viewable from the perspective shown in FIG. 3.

Figure 4:
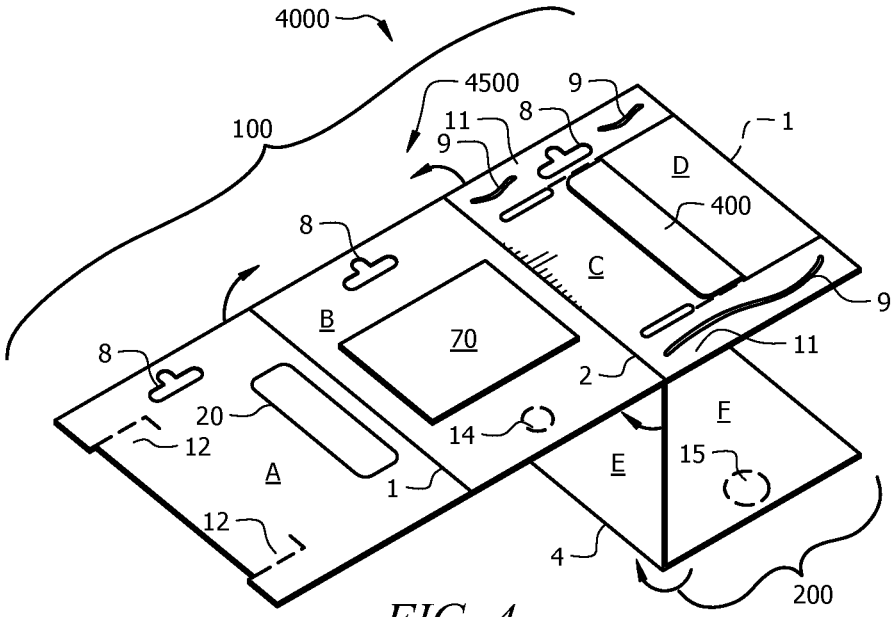
FIG. 4 shows a perspective view of an embodiment of the system and package.

FIG. 4 shows a perspective view of an embodiment of the system 4000 and package 4500. The first portion 100 and second portion 200 have the same number of panels as the first portion 100 of and second portion 200 of system 1000 and package 500 in FIG. 1. FIG. 4 shows the second portion 200 may be foldably connected to the first portion 100 via fold line 2 (instead of via fold line 4 as in FIG. 1). FIG. 4 shows locations of a permanent adhesive 9, which may be applied during the initial folding of the package 4500 and system 4000.

Fourth panel D is shown in FIG. 4 as folded against the third panel C, with the card product 400 between the fourth panel D and the third panel C. To completely fold first and second portions 100 and 200 of the system 4000 and package 4500 to the folded state, and subsequently to the closed position, the panels A, B, C, D, E, and F may be folded in the direction of the arrows shown in FIG. 4 so that fasteners 14 and 15 may releasably attach. Fastener 14 may be positioned on panel F of the second portion 200, and fastener 15 may be positioned on panel B of the first portion 100. The dashed lines of the fasteners 14 and 15 indicate the fasteners are positioned on the face of the panels F and B not viewable from the perspective shown in FIG. 4.

Figure 5:
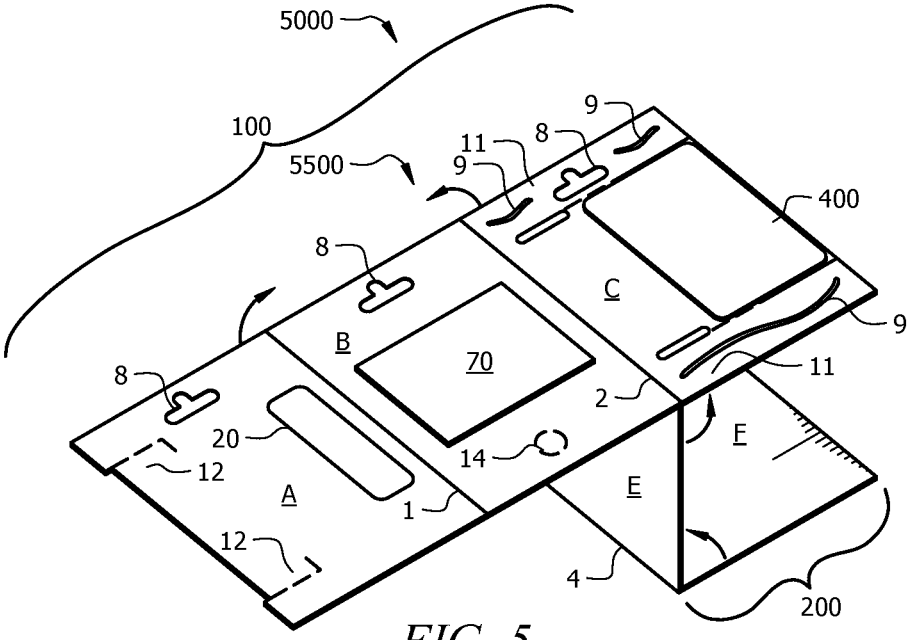
FIG. 5 shows a perspective view of an alternative embodiment of the system and package shown in FIG. 4.

FIG. 5 shows a perspective view of an alternative embodiment of the system and package of FIG. 4. The package 5500 of system 5000 shown in FIG. 5 may have a first portion 100 having three panels A, B, and C. The first portion 100 and second portion 200 have the same number of panels as the first portion 100 and second portion 200 of system 2000 and package 2500 in FIG. 2. In FIG. 5, the second portion 200 may be foldably connected to the first portion 100 via fold line 2 (instead of via fold line 4 as in FIG. 2).

To fold first and second portions 100 and 200 of package 5500 of system 5000 to the folded state, and subsequently to the closed position, the panels A, B, C, E, and F may be folded in the direction of the arrows shown in FIG. 5.

FIGS. **6*a*-6*c*** show a sequence for folding an embodiment of the disclosed system and package.

Figure 6A:
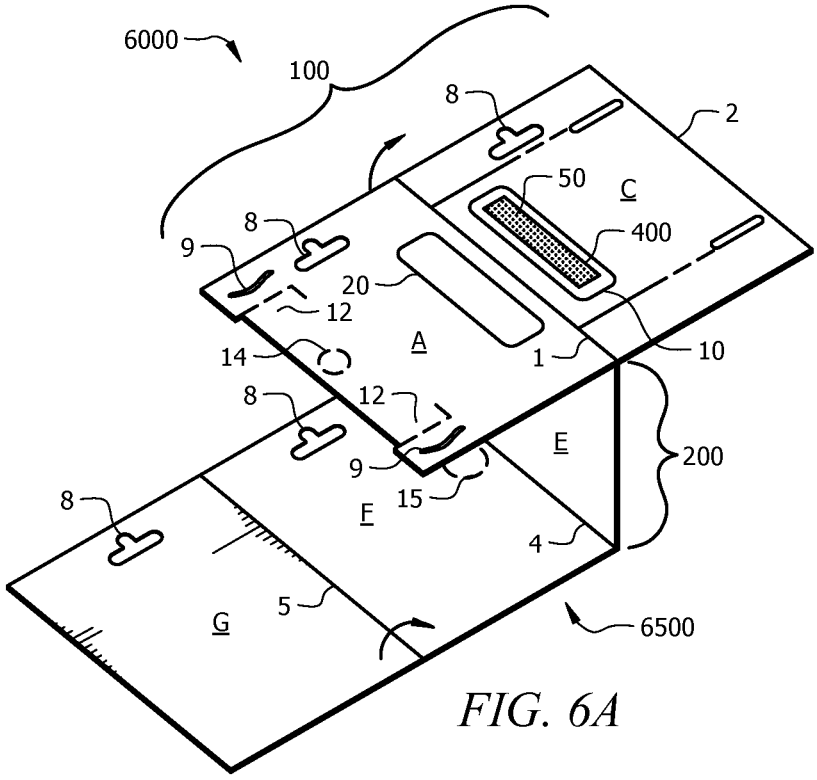
FIG. 6*a* shows a perspective view of an embodiment of the system and package, with third panel C folded upon second panel B.

FIG. **6*a* shows a perspective view of an embodiment of the system 6000 and package 6500. The second portion 200 may be connected to the first portion 100 at fold line 1. Fastener 14 may be attached to the first panel A of the first portion 100, and fastener 15 may be attached to the intermediate panel F of the second portion 200. As shown in FIG. 6*a*, fastener 15 may have a larger size than fastener 14. Third panel C in FIG. 6*a* has been folded about second panel B via fold line 2 so that only panel C is visible in FIG. 6*a*. A portion of the card product 400 (e.g., the bar code 50) may be visible through opening 10. The panels A, E, F, and G may be folded in the direction of the arrows so the first portion 100 and second portion 200** are in the folded state.

Figure 6B:
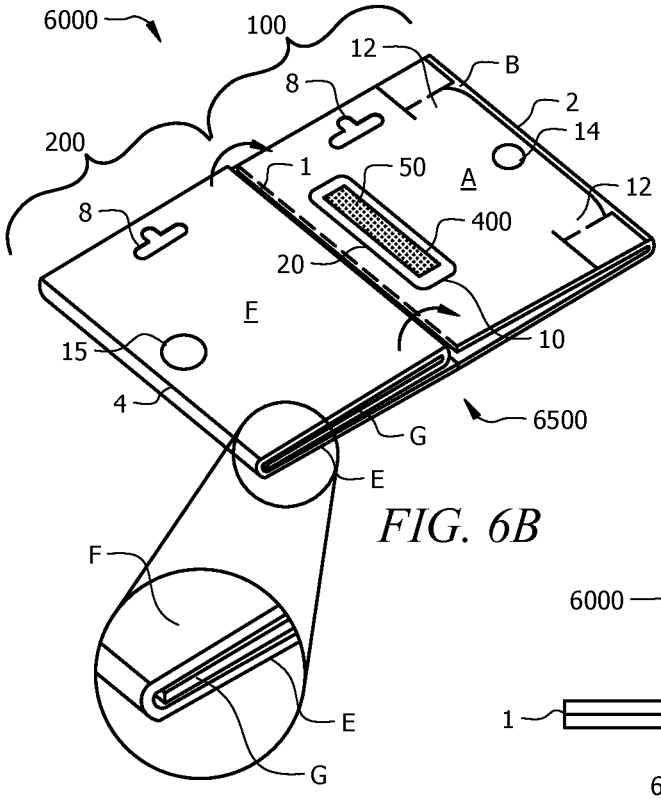
FIG. 6*b* shows a perspective view of the system and package of FIG. 6*a* with the first and second portions in the folded state.

FIG. **6*b* shows a perspective view of the system 6000 and package 6500 of FIG. 6*a* with the first portion 100 and the second portion 200 in the folded state, or completely folded. To completely fold the first portion 100 of the system 6000 and package 6500 to the folded state, first panel A may fold against folded third panel C along fold line 1, and after folding of the first portion 100 is complete, only first panel A may be visible from one side, and only second panel B may be visible from the opposite side. A portion of the card product 400 (e.g., the bar code 50) may be visible through opening 20 and the opening 10 when the first portion 100 and the second portion 200 of the package 6500 are completely folded in the closed position. The opening 20 in the first panel A may substantially overlap opening 10 in panel C when the first portion 100 is in the folded state. The term substantially overlap means that a majority of one opening is overlapped by the other opening such that the majority of the opening faces the area on the opposite side of the panel that defines the other opening. Thus, the information disposed on the card product 400, such as a barcode 50, may be scannable from the card product 400 even when the first and second portions 100 and 200 of the package 6500 are in a closed position. To completely fold the second portion 200 of the system 6000 and package 6500 to the folded state, outer panel G may be folded about intermediate panel F via fold line 5, and intermediate panel F may then be folded about inner panel E via fold line 4 so that outer panel G is between the intermediate panel F and inner panel E, as shown in FIG. 6***b*. In FIG. 6*b*, fastener 15 can be seen on intermediate panel F of the second portion 200, and fastener 14 can be seen on first panel A of the first portion 100. To fold the system 6000 and package 6500 to the closed position, second portion 200 may be folded about the first portion 100 in the direction of the arrows shown in FIG. 6*b*

Figure 6C:
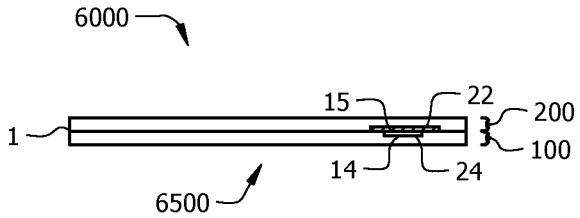
FIG. 6*c* shows a perspective view of the system and package of FIG. 6*b* with first portion and second portion in the closed position.

FIG. 6*c* shows a side elevational view of the system 6000 and package 6500 of FIGS. 6*a* and 6*b*, with the first portion 100 and second portion 200 in the closed position. In the closed position, first panel A of the first portion 100 may fold against intermediate panel F of the second portion 200. The first portion 100 may fold against the second portion 200 via fold line 1. The first fastener 14 is shown releasably attached to the second fastener 15. In FIG. 6*c*, fasteners 14 and 15 are shown of differing sizes, and fastener 15 is larger than fastener 14. The first portion 100 may comprise a recessed area 22 in one or more of the panels. The fastener 14 may be positioned in the recessed area 22 of the first portion. The second portion 200 may comprise a recessed area 24 in one or more of the panels. The fastener 15 may be positioned in the recessed area 24 of the second portion 200. The fasteners 14 and 15 may comprise a hook-and-loop type fastener which may be easily releasably attached.

The fasteners 14 and 15 enable the system 6000 and package 6500 to be opened and closed many times without comprising the integrity thereof. For example, a user (e.g., a customer) may see information displayed on the first and/or second portions 100 and 200 regarding the card product 400, and the user may choose to know more about the card product 400. The user may open the disclosed system 6000 and package 6500 and unfold the panels of the second portion, and view any information on the panels and the optional booklet that may be included in the system 6000 and package 6500. If the user chooses to keep (e.g., purchase) the card product 400 contained in the system 6000, the system 6000 allows two method for access of the card product 400 and at least two methods for activation of the card product 400. The user may choose not to purchase the card product 400, and the first and second portions 100 and 200 of the system 6000 may be folded in the folded state and subsequently to the closed position. The user may then return the system 6000 to a display or person, and the system 6000 may be ready for viewing by another user without experiencing any loss of function or compromised integrity.

Figure 7:
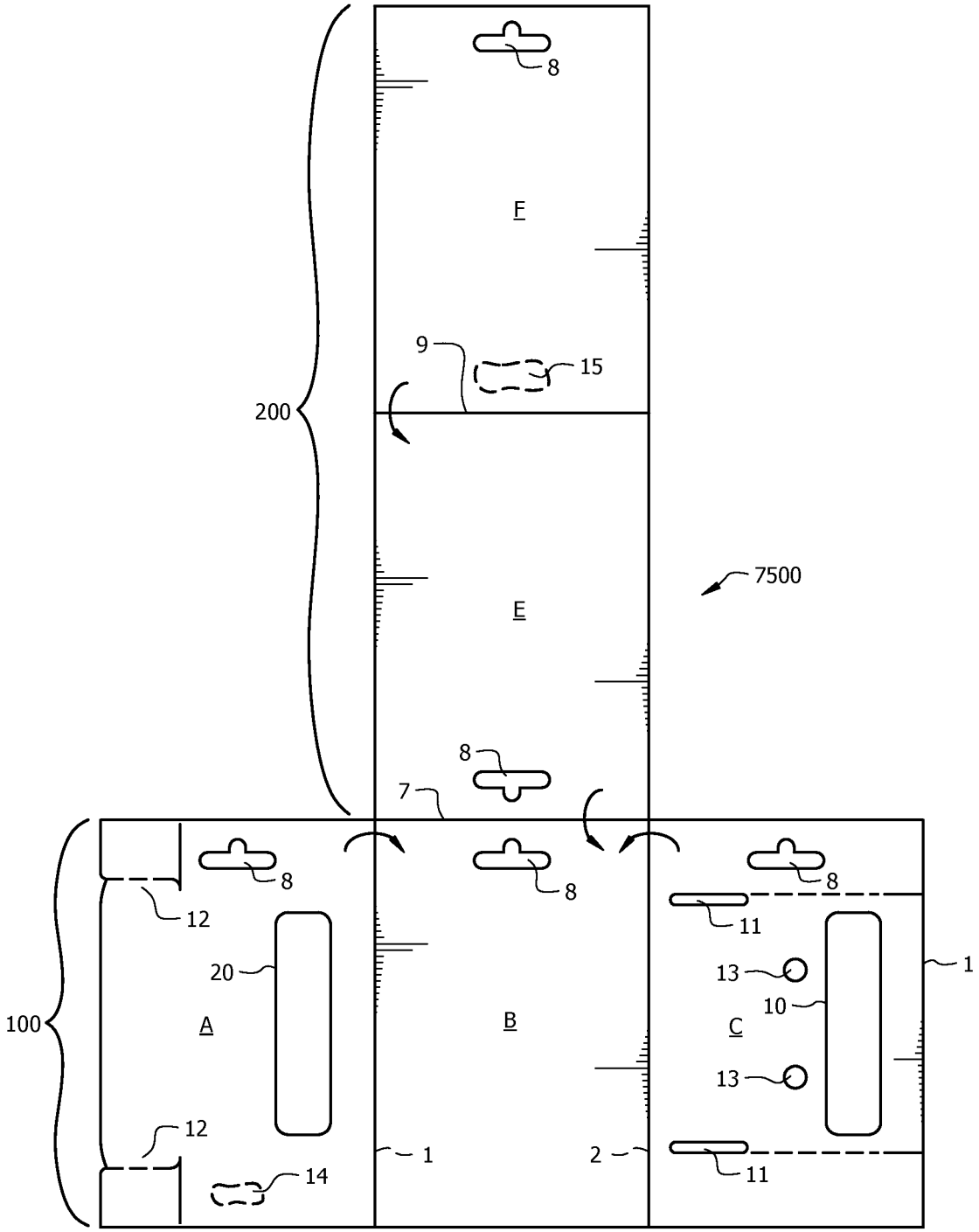
FIG. 7 shows a perspective view of an embodiment of the system and package.

FIG. 7 shows a perspective view of an embodiment of the disclosed package 7500. Package 7500 may be used with a card product; although a card product is not shown in FIG. 7. In FIG. 7, first portion 100 and second portion 200 have the same number of panels as the first portion 100 and second portion 200 of FIG. 2. The first portion 100 may be connected to the second portion 200 via fold line 7. Particularly, inner panel E of second portion 200 may be connected second panel B of the first portion 100 via fold line 7. Outer panel F may be connected to inner panel E via fold line 9. The embodiment of the system 7000 may have second portion 200 connected to first portion 100 via short sides of said portions 100 and 200 instead of the long sides as depicted in FIGS. 1-6*c*. To completely fold first and second portions 100 and 200 of the package 6500 to the folded state, and subsequently to the closed position, the panels A, B, C, E, and F may be folded in the direction of the arrows shown in FIG. 7 so that fasteners 14 and 15 releasably attach.

Figure 8:
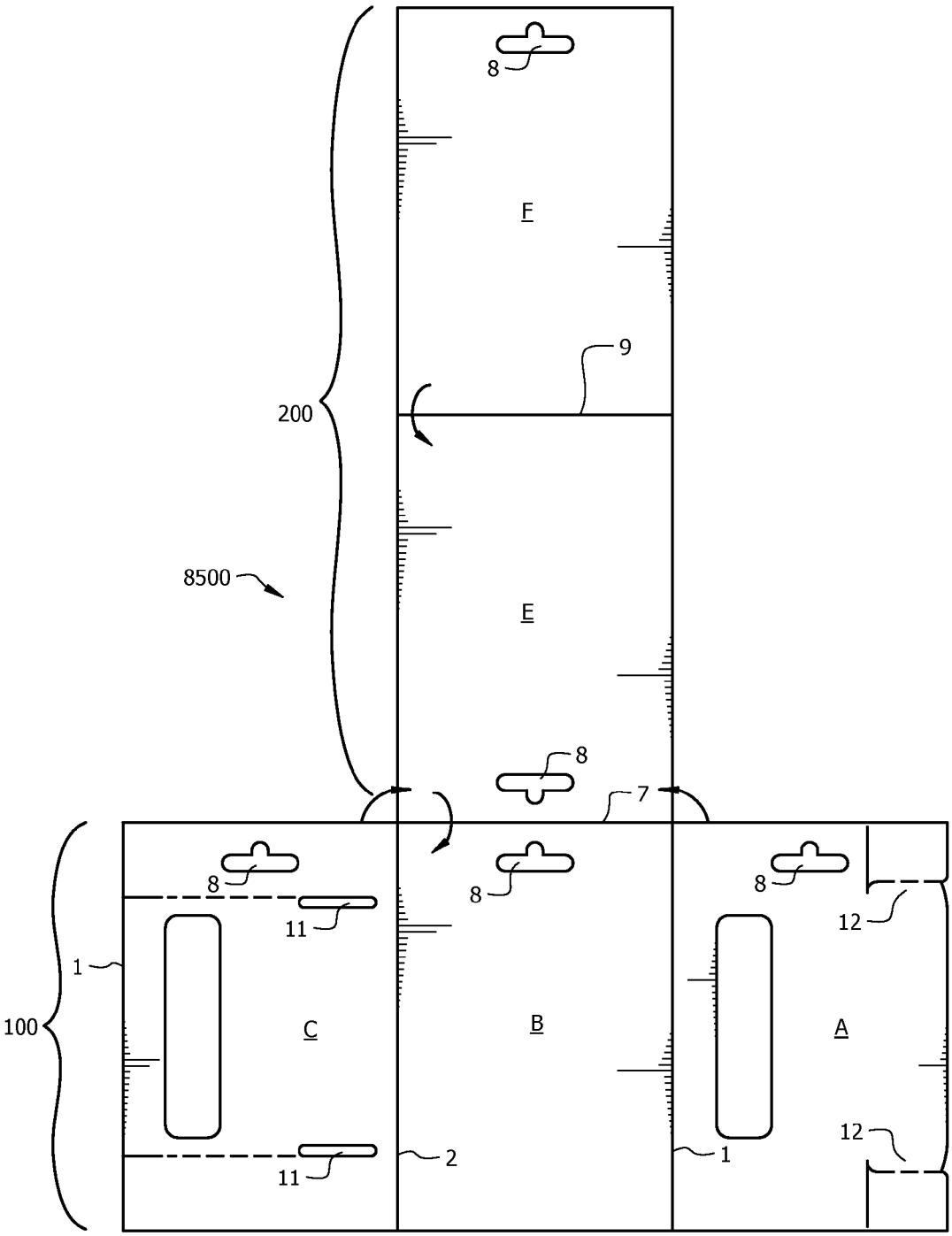
FIG. 8 shows a perspective view of an alternative embodiment of the system and package of FIG. 7.

FIG. 8 shows a perspective view of an alternative embodiment of the package shown in FIG. 7. Package 8500 has the same configuration of package 7500 in FIG. 7, except first panel A and third panel C have been switched.

The present disclosure also includes a method for display and sale of a card product. In an embodiment, the method may include providing a first portion of a package having the card product removably attached therein, enclosing the card product within the first portion when the first portion is in a folded state, providing a second portion of the package foldably connected to the first portion, releasably attaching a first fastener to a second fastener when the first and second portions are in the closed position, displaying information relating to the card product on the second portion when the first and second portions are in the closed position and in an open position, and revealing at least a portion of the card product through an opening formed in the first portion. The first and second fasteners may be reattachably-separable.

The method may further comprise folding a first panel of the first portion against a second panel of the first portion via a first fold line of the first portion, folding the second panel of the first portion against a third panel via a second fold line of the first portion, folding a fourth panel of the first portion against the third panel via a third fold line of the first portion, and at least partially overlapping the first opening with the second opening to reveal at least a portion of the card product through the first and second openings.

In one embodiment, the method may further comprise folding an inner panel of the second portion against the first portion, wherein the first portion is in the folded state, wherein the first fastener is positioned on the first portion, wherein the second fastener is positioned on the inner panel of the second portion.

In an alternative embodiment, the method may further comprise folding an outer panel of the second portion against an inner panel of the second portion, and folding the outer panel of the second portion against the first portion, wherein the first portion is in the folded state, wherein the first fastener is positioned on the first portion, wherein the second fastener is positioned on the outer panel of the second portion.

In an alternative embodiment, the method may further comprise folding an intermediate panel of the second portion against an inner panel of the second portion so that an outer panel of the second portion extends over the first portion, and folding the intermediate panel of the second portion against the outer panel of the second portion, wherein the first portion is in the folded state, wherein the first fastener is positioned on the first portion, wherein the second fastener is positioned on the intermediate panel of the second portion.

In an alternative embodiment, the method may further comprise folding a third portion against the first portion, wherein the third portion is foldably connected to the first portion, and folding the second portion against the third portion, wherein the first portion is in the folded state, wherein the first fastener is positioned on the third portion, wherein the second fastener is positioned on the second portion.

Although only certain embodiments of this invention have been described in detail above, those skilled in the art will readily appreciate that many modifications are possible in the exemplary embodiment without materially departing from the novel teachings and advantages of this invention. Accordingly, all such modifications are intended to be included within the scope of this invention.

While preferred embodiments have been shown and described, modifications thereof can be made by one skilled in the art without departing from the spirit and teachings of the disclosed embodiments. The embodiments described herein are exemplary only, and are not intended to be limiting. Many variations and modifications of the embodiments disclosed herein are possible and are within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present disclosure. Thus, the claims are a further description and are an addition to the disclosed embodiments. The discussion of a reference in the Description of Related Art is not an admission that it is prior art, especially any reference that may have a publication date after the priority date of this application. The disclosures of all patents, patent applications, and publications cited herein are hereby incorporated by reference, to the extent that they provide exemplary, procedural or other details supplementary to those set forth herein.

What we claim is:

1. A package for display and sale of a card product comprising:

a first portion including a first panel connected to a second panel via a first fold line and a third panel connected to the second panel via a second fold line, the first panel including a first opening, the third panel including a second opening, which, in a folded state where the first panel has been folded to overlap the second panel via the first fold line and the second panel has been folded to overlap the third panel via the second fold line and a fourth panel has been folded to overlap the third panel via a third fold line, the first opening at least partially overlaps the second opening;

a second portion directly foldably connected to the first panel of the first portion, wherein the second portion displays information about the card product;

a first fastener; and a second fastener releasably attached to the first fastener when the first portion and the second portion are in a closed position, wherein the first fastener and the second fastener re-attachably separate from one another when the first portion and the second portion are in an open position.

2. The package of claim 1, further comprising:

a third portion foldably connected to the first portion, wherein the third portion displays information about the card product, wherein the first fastener is positioned on the third portion and the second fastener is positioned on the second portion.

3. The package of claim 1 wherein the first and second fasteners together comprise a hook-and-loop fastener, wherein the first fastener and the second fastener differ in size.

4. The package of claim 1 wherein the first panel of the first portion includes at least one tab, bounded in part, by perforated portions of the first panel, the at least one tab extending to an edge of the first panel opposite the first fold line.

5. The package of claim 4 wherein the third panel includes at least one elongated slot positioned in a direction perpendicular to the second fold line and overlapping the at least one tab.

6. The package of claim 1 wherein the second portion comprises:

a inner panel foldably connected to the first portion; and an outer panel foldably connected to a side of the inner panel opposite the first portion, wherein the second fastener is attached to the outer panel.

7. The package of claim 1 wherein the second portion comprises:

a inner panel foldably connected to the first portion;

an intermediate panel foldably connected to a side of the inner panel opposite the first portion; and an outer panel foldably connected to a side of the intermediate panel opposite the first portion, wherein the second fastener is attached to the inner panel.

8. The package of claim 7 wherein outer panel of the second portion has a width smaller than a width of the inner panel.

9. The package of claim 7 wherein a face of the outer panel is releasably attached with an adhesive to a face of the inner panel when the second portion is in a folded state.

10. The package of claim 1 further comprising:

a booklet connected to the first portion or the second portion.

11. The package of claim 1 wherein the first portion comprises a recessed area, wherein the first fastener is positioned in the recessed area of the first portion.

12. The package of claim 1 wherein the first fastener is positioned on the first portion and the second fastener is positioned on the second portion.

13. A package system comprising:

a first portion including a first panel connected to a second panel via a first fold line and a third panel connected to the second panel via a second fold line, the first panel including a first opening, the third panel including a second opening, which, in a folded state where the first panel has been folded to overlap the second panel via the first fold line and the second panel has been folded to overlap the third panel via the second fold line and a fourth panel has been folded to overlap the third panel via a third fold line, the first opening at least partially overlaps the second opening;

a card product on which information is recorded, wherein the card product is removably attached to the first portion, wherein information on the card product is scannable or viewable through the first and second openings;

a second portion directly foldably connected to the first panel of the first portion, wherein the second portion displays information about the card product;

a first fastener; and a second fastener releasably attached to the first fastener when the first portion and the second portion are in a closed position, wherein the first fastener and the second fastener re-attachably separated from one another when the first portion and the second portion are in an open position.

14. The package system of claim 13 further comprising:

a third portion foldably connected to the first portion, wherein the third portion displays information about the card product, wherein the first fastener is positioned on the third portion and the second fastener is positioned on the second portion.

15. The package system of claim 13 wherein the first and second fasteners together comprise a hook-and-loop fastener, wherein the first fastener and the second fastener differ in size.

16. The package system of claim 13 wherein the first panel of the first portion includes at least one tab, bounded in part, by perforated portions of the first panel, the at least one tab extending to an edge of the first panel opposite the first fold line.

17. The package system of claim 13 wherein the card product includes a barcode and a magnetic portion, wherein the barcode and magnetic portion both include recorded information.

18. The package system of claim 17 wherein the barcode is scannable through the first and second openings.

19. The package system of claim 13 wherein the card product includes an entry code and a magnetic portion, wherein the magnetic portion includes recorded information.

20. The package system of claim 19 wherein the entry code is viewable through the first and second openings.

* * * * *